US005338476A

United States Patent [19]

Pancheri et al.

[11] Patent Number: 5,338,476

[45] Date of Patent: Aug. 16, 1994

[54] GRANULAR LAUNDRY DETERGENT COMPOSITIONS HAVING IMPROVED SOLUBILITY

[75] Inventors: Eugene J. Pancheri, Montgomery; Meleksima Koc, Cincinnati, both of Ohio

[73] Assignee: The Procter & Gamble Company, Cincinnati, Ohio

[21] Appl. No.: 98,170

[22] Filed: Jul. 28, 1993

Related U.S. Application Data

[63] Continuation of Ser. No. 688,009, Apr. 19, 1991, abandoned.

[51] Int. Cl.[5] ..... C11D 3/12; C11D 1/02; C11D 1/38; C11D 1/66

[52] U.S. Cl. ..... 252/174.14; 252/174; 252/174.19; 252/174.25; 252/550

[58] Field of Search ..... 252/174.19, 174.25, 252/174.14, 95, 134, 135, 108, 174.13, 174, 550

[56] References Cited

U.S. PATENT DOCUMENTS

| | | | |
|---|---|---|---|
| 2,381,960 | 8/1945 | Johnson | 270/697 |
| 3,929,678 | 12/1975 | Laughlin et al. | 252/526 |
| 4,169,074 | 7/1979 | Conrad et al. | 252/544 |
| 4,299,717 | 11/1984 | Cottrell et al. | 252/99 |
| 4,507,219 | 3/1985 | Hughes | 252/118 |
| 4,560,492 | 12/1985 | Curry et al. | 252/110 |
| 4,715,979 | 12/1987 | Moore et al. | 252/91 |
| 4,810,413 | 3/1989 | Pancheri et al. | 252/174.17 |
| 4,810,415 | 3/1989 | Pancheri et al. | 252/174.17 |
| 4,983,315 | 1/1991 | Glagowski et al. | 252/102 |
| 5,108,646 | 4/1992 | Beerse et al. | 252/174.25 |
| 5,180,515 | 1/1993 | Boucher et al. | 252/135 |

FOREIGN PATENT DOCUMENTS

| | | | |
|---|---|---|---|
| 0110588A1 | 6/1984 | European Pat. Off. | C11D 3/10 |
| 0313144A2 | 4/1989 | European Pat. Off. | C11D 3/395 |
| 0419036A2 | 3/1991 | European Pat. Off. | C11D 3/12 |
| 0456315A2 | 11/1991 | European Pat. Off. | C11D 3/12 |
| 61-164000 | 1/1985 | Japan . | |

OTHER PUBLICATIONS

Pending U.S. Application Serial No. 656,117, Boucher et al, filed Feb. 14, 1991 (which is a continuation of Serial No. 385,848, filed Jul. 27, 1989, now abandoned).

Pending U.S. Application Serial Numbers 520,571, Leslie et al, and 520,573, Siklosi et al, filed May 8, 1990.

Pending U.S. Application Serial No. 604,721, Beerse et al, filed Oct. 26, 1990.

Pending U.S. Application Serial No. 613,427, Nicholson, filed Nov. 14, 1990.

Chemical Principles, 4th ed. Masterton Slowinski, W. B. Saunders Co. 1977, pg. 435.

*Primary Examiner*—Michael Lewis
*Assistant Examiner*—Stephen G. Kalinchaic
*Attorney, Agent, or Firm*—Ken K. Patel; Jacobus C. Rasser; Donald E. Hasse

[57] ABSTRACT

Granular detergent compositions containing admixed sodium carbonate and low levels of admixed citric acid to improve solubility. The compositions preferably contain aluminosilicate detergent builders and preferably are free of phosphate builders. Also disclosed are processes for improving solubility of granular detergent compositions.

13 Claims, No Drawings

GRANULAR LAUNDRY DETERGENT COMPOSITIONS HAVING IMPROVED SOLUBILITY

This is a continuation of application Ser. No. 07/688,009, filed on Apr. 19, 1991, now abandoned.

FIELD OF THE INVENTION

The present invention relates to granular laundry detergent compositions containing admixed sodium carbonate which have improved solubility in the laundering solution. More particularly, it relates to the addition of low levels of admixed citric acid to such granular laundry detergents to improve their solubility under washing conditions which inhibit dispersion in water. Processes for improving solubility of granular detergent compositions containing admixed sodium carbonate by admixing citric acid in selected ratios are also included.

BACKGROUND OF THE INVENTION

Granular laundry detergents containing admixed sodium carbonate have been found to exhibit poor solubility under certain conditions. This results in clumps of detergent, which appear as solid white masses ranging from about 5 to 40 millimeters in diameter and about 2 to 10 millimeters in length, remaining in the washing machine and on washed clothes. Such clumps usually occur when the detergent is placed in a pile, particularly during cold water washes and/or when the order of addition to the washing machine is laundry detergent first, clothes second, and water last. It has been found that the primary contributor to this solubility problem is the admixed sodium carbonate in the laundry detergent. While not intending to be limited by theory, it is believed that this solubility problem is caused by hydration of the sodium carbonate, which results in a sticky, poorly soluble mass, before the granular detergent can be dispersed and solubilized in the laundering solution. Surprisingly, granular detergents containing sodium carbonate as part of a spray dried base granule usually do not exhibit this solubility problem, apparently because the carbonate is uniformly dispersed in a matrix of more soluble ingredients. Granular detergents also generally have poorer solubility if they contain sodium pyrophosphate builder.

Sodium carbonate and sodium pyrophosphate have been used in granular detergent compositions (for example, U.S. Pat. No. 4,299,717, Cottrell et al, issued Nov. 10, 1981). Potassium salt has been substituted for sodium salt to eliminate giant micelles of sodium salt of washed fatty acid in the washing liquid (Japanese Patent Application 61164000). The solubility of a solid is lower in a solution of a salt containing a common ion than in pure water (*Chemical Principles,* 4th ed., Masterton Slowinski, W. B. Saunders Co. 1977, pg. 435). A water-softening composition comprising tetrasodium pyrophosphate and an alkaline material selected from the group consisting of trisodium phosphate, sodium hydroxide, sodium carbonates, potassium hydroxide, potassium carbonates, soap and sodium silicate is disclosed in U.S. Pat. No. 2,381,960, Johnson, issued Aug. 14, 1945.

Citric acid has been used as a detergent builder in liquid laundry detergent compositions (see, for example, U.S. Pat. No. 4,507,219, Hughes, issued Mar. 26, 1985). Citric acid has also been disclosed as a builder for granular detergent compositions (e.g., U.S. Pat. No. 4,169,074, Conrad et al, issued Sep. 25, 1979). However, because granular laundry detergents are typically formulated to provide a wash water pH of about 9.8 to 10.5, salts of citric acid such as sodium citrate are more commonly disclosed in granular detergents (see, for example, U.S. Pat. No. 4,715,979, Moore et al, issued Dec. 29, 1987).

It has now been discovered that the addition of low levels of citric acid to granular laundry detergents containing admixed sodium carbonate improves their solubility in the laundering solution and eliminates or reduces the problem of clumps remaining in the washing machine and on washed clothes. It is believed that the citric acid rapidly reacts with the sodium carbonate in the laundering solution to release carbon dioxide. This helps disperse the detergent and minimize the formation of insoluble clumps.

SUMMARY OF THE INVENTION

The invention encompasses a granular laundry detergent composition comprising, by weight:

(a) from about 5 to 70% detergent surfactant selected from the group consisting of anionics, nonionics, zwitterionics, ampholytics, cationics, and mixtures thereof;

(b) from about 5 to 75% of admixed sodium carbonate; and (c) up to about 15% of admixed citric acid; wherein the weight ratio of (b):(c) is from about 2:1 to about 15:1.

A process for improving solubility of a granular laundry detergent composition according to the above is also presented.

DESCRIPTION OF THE INVENTION

This invention covers a granular laundry detergent composition containing admixed sodium carbonate and citric acid. The composition is soluble in cold or cool water, i.e. the composition readily dissolves/disperses in water at a temperature between about 32° F. (0° C.) and 90° F. (32.2° C.), preferably between about 35° F. (1.6° C.) and 50° F. (10° C.). Because of the incorporation of the citric acid, no significant amount of product remains bound in the clothes or in the bottom of the washing machine tub after a typical cold water wash cycle, even with a "reverse" order of addition to the washing machine, i.e., product first, clothes second, water last.

The granular detergent compositions of the present invention thus contain three essential ingredients: detergent surfactant, sodium carbonate, and citric acid. These and optional ingredients, and processes for making the detergents, are described in detail hereinafter.

A. Detergent Surfactant

The first ingredient, present at a level of from about 5 to 70 weight % is a detergent surfactant selected from the group consisting of anionics, nonionics, zwitterionics, ampholytics, cationics, and mixtures thereof. Preferably the surfactant represents from about 10 to 30%, most preferably from about 12 to 25%, by weight of the composition and is selected from the group consisting of anionics, nonionics, and mixtures thereof.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS.

Especially preferred are mixtures of $C_{10-16}$ (preferably $C_{11-13}$) linear alkylbenzene sulfonates and $C_{12-18}$ (preferably $C_{14-16}$) alkyl sulfates. These are preferably present in a weight ratio of between 4:1 and 1:4, preferably about 3:1 to 1:3, alkylbenzene sulfonate: alkyl sulfate. Sodium salts of the above are preferred.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are al so useful in the instant detergent granules. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol .

Included are the water-soluble and water-dispersible condensation products of aliphatic alcohols containing from 8 to 22 carbon atoms, in either straight chain or branched configuration, with from 3 to 12 moles of ethylene oxide per mole of alcohol .

Semi-polar nonionic surfactants include water-soluble amine oxides containing one alkyl moiety of from abut 10 to 18 carbon atoms and two moleties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80.

Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol .

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent granules. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, which is incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

B. Sodium Carbonate

The granular detergent compositions of the present invention also contain from about 5 to 75 weight %, preferably from about 7 to 50 weight %, most preferably from about 10 to 30 weight %, of admixed sodium carbonate. Sodium carbonate ($Na_2CO_3$) can easily be obtained commercially. As described above, without the addition of citric acid, such compositions ordinarily have solubility problems under laundering conditions such as when added to the washing machine tub in a pile, particularly when "reverse" order of addition is used and/or cold water is used.

C. Citric Acid

The third required ingredient herein, which is present at a level up to about 15 weight %, preferably from about 1 to 10 weight %, most preferably from about 2 to 7 weight %, is citric acid.

In order to provide sufficient citric acid to improve the solubility of granular detergents containing admixed sodium carbonate, the weight ratio of admixed sodium carbonate to admixed citric acid should be from about 2:1 to about 15:1, preferably from about 2.5:1 to about 10:1, most preferably about 3:1 to about 6:1. A detergent grade of citric acid is preferred.

D. Other Ingredients

Other ingredients suitable for inclusion in a granular laundry detergent composition can be added to the present compositions. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in U.S. Pat. No. 3,936,537, issued Feb. 3, 1976 to Baskerville, Jr. et al., incorporated herein by reference.

Auxiliary builders (other than the required sodium carbonate and citric acid) can be employed to sequester hardness ions and to help adjust the pH of the laundering liquor. Such builders can be employed in concentrations up to about 85% by weight, preferably from about 5% to about 50% by weight, most preferably from about 10% to about 30% by weight, of the detergent compositions herein to provide their builder and pH-controlling functions. The builders herein include any of the conventional inorganic and organic water-soluble builder salts.

Such builders can be, for example, water-soluble salts of phosphates including tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates.

Nonphosphorus-containing materials can also be selected for use herein as builders.

Specific examples of nonphosphorus, inorganic detergent builder ingredients include water-soluble bicarbonate, and silicate salts. The alkali metal, e.g., sodium and potassium, bicarbonates, and silicates are particularly useful herein.

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A and has the formula $$Na_{12}[AlO_2)_{12}\cdot(SiO_2)_{12}]\cdot xH_2O$$

wherein x is from about 20 to about 30, especially about 27.

Water-soluble, organic builders are also useful herein. For example, the alkali metal, polycarboxylates are useful in the present compositions. Specific examples of the polycarboxylate builder salts include sodium and potassium, salts of ethylenediaminetetraacetic acid, nitrilotriacetic acid, oxydisuccinic acid, mellitic acid, benzene polycarboxylic acid, polyacrylic acid, and polymaleic acid.

Other desirable polycarboxylate builders are the builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

The compositions herein preferably contain little (e.g., less than 10%, preferably less than 5%, by weight) or no phosphate builder materials. The presence of higher levels of tripolyphosphate improves solubility of the compositions to the point where citric acid provides little or no additional improvements. However, sodium pyrophosphate reduces solubility so that the benefit provided by the citric acid is greater in granular detergents containing pyrophosphate.

Bleaching agents and activators useful herein are al so described in U.S. Pat. No. 4,412,934, Chung et al., issued Nov. 1, 1983, and i n U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al ., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

The granular laundry detergent compositions of the present invention can be formulated to provide a pH (measured at a concentration of 1% by weight in water at 20° C.) of from about 7 to about 11.5. A pH range of from about 9.5 to about 11.5 is preferred for best cleaning performance. Low pH compositions herein having a pH of from about 8 to about 9.5, more preferably from about 8.5 to about 9.0, have a weight ratio of admixed carbonate to admixed citric acid at the lower end of the claimed range (for example, about or approaching 2:1). Such compositions contain more citric acid, relative to the amount of admixed carbonate, than necessary to improve solubility. The additional citric acid thus is present primarily to lower pH in the wash water.

Preferably, such lower pH compositions also contain a chlorine scavenger employed in an effective amount to control residual chlorine in the wash and rinse water. The amount of chlorine scavenging material needed will vary, but only a small amount is used to avoid destroying hypochlorite bleach that may be added deliberately to treat bleach-sensitive stains.

When present in the compositions of the invention chlorine scavengers should not be used in a large excess since they will interfere with normal hypochlorite bleaches added to the wash water for stain removal and whitening. The level should be from about 0.01% to about 10%, preferably from about 0.05% to about 5%, most preferably from about 0.08 to about 2%, based on the molar amount equivalent to react with about 0.5 to about 2.5, typically about 1, ppm of available chlorine, per average rinse. If both the cation and the anion of the scavenger react with chlorine, which is desirable, the level is adjusted to react with an equivalent amount of available chlorine.

Suitable chlorine scavengers include the following polymers which can be divided into four groups according to their structural construction: polyethylene imines, polyamines, polyamineamides and polyacrylamides, of which the polyethyleneimines, the polyamines and polyamineamides are especially preferred.

Suitable polyethyleneimines are obtained by acid-catalyzed polymerization of ethyleneimine and can be modified by urea and epichlorhydrin or dichlorethane. Polyethyleneimines can contain primary, secondary or tertiary amino groups as well as quaternary ammonium groups. Aqueous solutions of polyethyleneimines show basic reaction. The molecular weight can amount up to about 1,000,000.

Polyamines are addition or condensation products from multivalent aliphatic amines and compounds with several groups capable of reacting, for example, epichlorhydrin or alkylene dihalides. Therefore, they always contain several secondary, tertiary or even quaternary nitrogen atoms, as well as eventually also hydroxyl groups in the molecule. They are accordingly hydrophilic, polar compounds, which behave as polyelectrolytes and are water soluble, inasmuch as they do not contain large hydrophobic groups in the molecule. The polyamines exhibit basic reaction in aqueous solution. Suitable compounds, for example, are described in U.S. Pat. No. 2,969,302.

Polyamineamides contain amino- and amido groups in the molecule at the same time. They are made, for example, by condensation of multibasic acids, for example, dibasic, saturated, aliphatic $C_3$ to $C_8$ acids and polyamines, as well as with compounds, which contain several groups capable of reacting, such as, for example, epichlorhydrin. These compounds also demonstrate basic reaction in aqueous solution. Suitable polyamineamides are described, for example, in U.S. Pat. No. 2,926,154.

Polyacrylamides having amino groups and molecular weights up to several million are suitable for use herein. By building in carboxyl groups, which are formed, for example, by partial hydrolysis, anionic polyacrylamides are obtained in addition to amido groups, while polyacrylamides containing amino groups exhibit basic reaction in aqueous solution. Amino groups can be introduced, for example, by reaction with alkali and hypobromite or hypochlorite.

It is common to all polymers that they are water soluble. Such polymers are commercial products. Compounds especially well suited as inserts to the detergents conforming to the discovery are the polyethyleneimines and polyamines, which exhibit strong basic reaction in water. Examples of commercially available polyethyleneimines, which are particularly appropriate, are "Epomin SP-003" from Nippon Shokubai, "Lugalvan G20 and G35" from BASF, and "Ethyleneamine E-100" from Dow Chemical. These polymers can be added either alone or together with water soluble polymers from melamine or urea and formaldehyde. Other polymers suitable for the detergents conforming to the discovery are, for example, the water soluble polymers based on alkyleneimines, acrylamides as well as melamine or urea and formaldehyde, which are described in the "*Encyclopedia of Polymer Science and Technology*", John Wiley & Sons, Inc., New York, 1968, Vol. 9, p. 762. An addition of these polymers to the detergents conforming to the discovery in combination with the amino- and/or amido group-containing polymers causes an intensification of the dye-protective effect.

Preferred polymers for use in the preferred anionic surfactant containing compositions herein are polyethyleneimines. Polyethyleneimines are believed to be particularly efficient chlorine scavengers because they adsorb to cotton fibers. In an anionic surfactant matrix, ion pairing of the amines with surfactant or polymeric carboxylates tends to dramatically lower the solubility of the polymeric amine. The solubility of the polymeric amine complexes can be maintained by utilizing materials of relatively low molecular weight. The molecular weight of the chosen amine polymer should be controlled to achieve a fabric substantivity of preferably at least 50%. A low substantivity will not allow efficient carryover into the rinse. Preferred polyethyleneimines have a molecular weight of less than about 800, more preferably from about 200 to about 400.

The cationic charge and the solubility of the polymeric amine allow the deposition of the polymer onto cotton fabric. The affinity the polymer has for fabric increases with lower pH, or higher molecular weight. Thus, a balance of these properties (solubility, solution pH, and polymer molecular weight) controls the efficiency of the chlorine scavenger on fabric and in solution. The optimal composition will allow a balance of polymer on fabric (for carryover from wash to rinse) and in solution (for an efficiency rate of reaction with chlorine).

Other chlorine scavengers herein are anions selected from the group consisting of reducing materials like sulfite, bisulfite, thiosulfite, thiosulfate, iodide, nitrite, etc. and antioxidants like carbamate, ascorbate, etc. and mixtures thereof. Conventional non-chlorine scavenging anions like sulfate, bisulfate, carbonate, bicarbonate, nitrate, chloride, borate, phosphate, condensed phosphate, acetate, benzoate, citrate, formate, lactate, salicylate, etc. and mixtures thereof can be used with ammonium cations.

Other chlorine scavengers useful herein include ammonium sulfate (preferred), and primary and secondary amines of low volatility such as ethanolamines, amino acids and their salts, polyamino acids and their salts, fatty amines, glucoseamine and other aminated sugars. Specific examples include tris(hydroxymethyl) aminomethane, monoethanol amine, diethanol amine, sarcosine, glycine, iminodiacetic acid, lysine, ethylenediamine diacetic acid, 2,2,6,6-tetramethyl piperinol, and 2,2,6,6-tetramethyl piperinone.

Other chlorine scavengers include phenol, phenol sulfonate, 2,2-biphenol, tiron, and t-butyl hydroquinone. Preferred are meta-polyphenols such as resorcinol, resorcinol monoacetate, 2,4-dihydroxybenzoic acid, 3,5-dihydroxybenzoic acid, and 2,4-dihydroxyacetophenone.

Peroxide bleach sources, e.g. perborate, percarbonate and other persalts, can also be used in minor amounts (less than 3% by weight, preferably less than about 2%) as a chlorine scavenger herein. However, peroxides are not efficient chlorine scavengers because they cannot be used at high enough levels to carry over to the rinse water without risk of bleach damage to colors.

Detergent compositions comprising the chlorine scavenger and the detergent component can be provided having various ratios and proportions of these two materials. Of course, the amount of the chlorine scavenger can be varied, depending upon the level of residual chlorine expected by the formulator. Moreover, the amount of detergent component can be varied to provide either heavy-duty or light-duty products, as desired. This invention relates primarily to detergent compositions that contain essentially no additional ingredients which are chlorine scavengers. For example, the other materials present should not provide any substantial additional amounts of ammonium cations in the wash solution.

Particularly preferred low or no phosphate compositions herein are granular laundry detergents comprising by weight:

(a) from about 10% to about 30% of a mixture of a $C_{11}$–$C_{13}$ alkylbenzene sulfonate surfactant and a $C_{12}$–$C_{16}$ (preferably $C_{14}$–$C_{16}$) alkyl sulfate surfactant in a weight ratio of sulfonate surfactant to sulfate surfactant of from about 4:1 to about 1:4 (preferably about 3:1 to about 1:3);

(b) from about 1% to about 3% of an alkali metal (preferably sodium) silicate having a molar ratio of $SiO_2$ to alkali metal oxide of from about 1.0 to about 2.4;

(c) from about 10% to about 50% (preferably about 15% to about 30%) of a finely divided aluminosilicate ion exchange material selected from the group consisting of:

(i) crystalline aluminosilicate material of the formula:

$$Na_z[(AlO_2)_z(SiO_2)_y]\cdot xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg $CaCO_3$ eq./g and a calcium ion exchange rate of at least about 2 grains $Ca^{++}$/gallon/minute/gram/gallon;

(ii) amorphous hydrated aluminosilicate material of the empirical formula:

$$M_z(zAlO_2\cdot ySiO_2)$$

wherein M is sodium, potassium, ammonium, or substituted ammonium, z is from about 0.5 to about 2 and y is 1, said material having a magnesium ion exchange ion exchange capacity of at least about 50 milligram equivalents of $CaCO_3$ hardness per gram of anhydrous aluminosilicate and a $Mg^{++}$exchange rate of at least about 1 grain/gallon/minute/gram/gallon; and (iii) mixtures thereof;

(d) from about 7% to about 50% of admixed sodium carbonate;

(e) from about 1% to about 10% of admixed citric acid;

wherein the weight ratio of (d):(e) is from about 2.5:1 to about 10:1.

Preferred alumionosilicate ion exchange material is of the formula $Na_{12}[(AlO_2)_{12}(SiO_2)_{12}]\cdot xH_2O$, wherein x is from about 20 to about 30.

E. Process

Also included in the present invention is a process for improving solubility or dispersibility of a granular detergent composition as described above. The process comprises:

(a) producing detergent granules comprising detergent surfactant selected from the group consisting of anionics, nonionics, zwitterionics, ampholytics, cationics, and mixtures thereof; and (b) admixing with said detergent granules sodium carbonate and citric acid;

wherein the final detergent composition comprises from about 5 to 70 weight % of the detergent surfactant, from about 5 to 75 weight % of admixed sodium carbonate, and up to about 15 weight % of admixed citric acid, in a weight ratio of admixed sodium carbonate to admixed citric acid of from about 2:1 to about 15:1.

Preferred compositions for use in the process are as described above.

The following examples illustrate the compositions and processes of the present invention. All parts, percentages, and ratios herein are by weight unless otherwise specified.

EXAMPLE I

Granular detergent compositions of the present invention comprise the following ingredients at the indicated levels.

| Ingredient | Percent (Wt) I | II | III |
|---|---|---|---|
| Sodium 12.3 linear alkyl benzene sulfonate | 13.16 | 10.64 | 14.43 |
| Sodium $C_{14}$–$C_{15}$ alkyl sulfate | 5.64 | 4.56 | 6.18 |
| Citric acid | 3.50 | 3.00 | 6.00 |
| Sodium tripolyphosphate | — | — | 7.27 |
| Sodium pyrophosphate | — | — | 29.07 |
| Zeolite A, hydrate (1–10 micron size) | 26.30 | 21.30 | — |
| Sodium carbonate - total | 20.53 | 23.10 | 12.37 |
| (Sodium carbonate admixed) | (11.06 | 15.81 | 12.37) |
| Sodium silicate (1.6 ratio $NaO/SiO_2$) | 2.29 | 2.86 | 8.00 |
| Pentasodium diethylenetriamine pentaacetate | — | 0.43 | — |
| Polyethylene glycol 8000 | 1.73 | 1.44 | 0.61 |
| Sodium polyacrylate (MW 4500) | 3.39 | 2.72 | 1.52 |
| Protease enzyme* | 1.09 | 0.75 | 0.84 |
| Sodium perborate monohydrate | 0.82 | 4.21 | 0.41 |
| Nonanoyloxybenzene sulfonate | — | 6.00 | — |
| Sodium sulfate | 10.33 | 8.28 | 11.41 |
| Balance (including water, brightener, perfume, suds suppressor) | | to 100.0 | |

*Activity of 1.8 Anson units per gram.

Aqueous crutcher mixes of the above ingredients are prepared and spray-dried, except for the citric acid, sodium carbonate indicated as admixed, enzyme, perfume, perborate and nonanoyloxybenzene sulfonate, which are admixed, to provide finished detergent compositions.

After washing clothes using the above detergent compositions, little or no insoluble clumps remain on the clothes or in the washing machine tub, even when the "reverse" order of addition and cold wash water are used. Such compositions thus demonstrate better solubility than similar compositions not containing citric acid.

What is claimed is:

1. A granular laundry detergent composition comprising:
   (a) a spray dried detergent granule containing a detergent surfactant selected from the group consisting of anionics, nonionics, ampholytics, cationics, and mixtures thereof:
   (b) from about 5 to 75 weight % of admixed sodium carbonate: and
   (c) from about 7 to about 15 weight % of admixed citric acid;
   wherein the detergent surfactant comprises from about 5 to about 70 weight % of said composition, wherein the weight ratio of (b):(c) is from about 2:1 to about 15:1, wherein the composition is prepared by a process spray drying said detergent granule from an alkaline aqueous mix said sodium carbonate (b) and said citric acid (c) wherein said sodium carbonate (b) and said citric acid (c) are not spray dried, with said detergent granule whereby said sodium carbonate will react with said citric acid to release carbon dioxide when said composition is formed into a laundering solution.

2. A granular laundry detergent composition according to claim 1, comprising from about 10 to 30 weight % detergent surfactant selected from the group consisting of anionics, nonionics, and mixtures thereof.

3. A granular laundry detergent composition according to claim 2 wherein the detergent surfactant comprises a mixture of $C_{11}$–$C_{13}$ linear alkylbenzene sulfonate and $C_{14}$–$C_{16}$ alkyl sulfate surfactants.

4. A granular laundry detergent composition according to claim 3 comprising from about 12 to 25 weight % of a mixture of the alkylbenzene sulfonate and alkyl sulfate surfactants in a weight ratio of from about 1:4 to about 4:1.

5. A granular laundry detergent composition according to claim 2 comprising from about 10 to 30 weight % admixed sodium carbonate.

6. A granular laundry detergent composition according to claim 5 comprising from about 2 to 7 weight % admixed citric acid.

7. A granular laundry detergent composition according to claim 6 comprising from about 12 to 25 weight % of a mixture of $C_{11}$–$C_{13}$ linear alkylbenzene sufonate and $C_{14}$–$C_{16}$ alkyl sulfate surfactants.

8. A granular laundry detergent composition according to claim 1 comprising from about 10% to about 50% by weight of an aluminosilicate ion exchange material of the formula $$Na_{12}[(AlO_2)_{12}(SiO_2)_{12}]\cdot xH_2O,$$

wherein x is from about 20 to about 30.

9. A granular laundry detergent composition according to claim 8 which is substantially free of phosphate builder material.

10. A granular laundry detergent composition according to claim 9 comprising, by weight:
   (a) from about 12 to 25 weight % sodium $C_{11-13}$ linear alkylbenzene sulfonate and sodium $C_{14-16}$ alkyl sulfate in a ratio between 3:1 and 1:3;
   (b) from about 10 to 30% admixed sodium carbonate;
   (c) from about 2 to 7% admixed citric acid; and
   (d) from about 15% to about 30% of aluminosilicate ion exchange material of the formula $$Na_{12}[(AlO_2)_{12}(SiO_2)_{12}]\cdot xH_2O,$$

wherein x is from about 20 to about 30.

11. A process for preparing a granular laundry detergent composition comprising an admixture of detergent granules, sodium carbonate and citric acid, whereby sodium carbonate in said composition will react with citric acid in said composition when said composition is formed into an aqueous laundering solution, said process consisting essentially of the steps of
   a) spray drying detergent granules comprising a detergent surfactant selected from the group consisting of anionics, nonionics, ampholytics, cationics and mixtures thereof, the said detergent granules having been prepared from an alkaline, aqueous mix;
   b) sodium carbonate and admixing a mixture consisting essentially of; and
   c) citric acid
   wherein said sodium carbonate and said citric acid are not spray dried with said detergent granules so as to form a final granular composition which comprises an admixture of said detergent granules, from about 5 to 75 weight of admixed sodium carbonate and from 1 to 15 weight % admixed citric acid, and wherein the weight ratio of admixed sodium carbonate to admixed citric acid is from about 2:1 to about 15:1, and wherein the amount of detergent surfactant in said composition is from about 5 to about 70%. and admixing said detergent granule with a mixture consisting essentially of 12. A process for improving solubility or dispersibility of a granular laundry detergent composition according to claim 11 wherein the resulting detergent composition comprises from about 12 to 25 weight % sodium linear $C_{11-13}$ alkylbenzene sulfonate and sodium $C_{14-16}$ alkyl sulfate, from about 10 to 30 weight % of admixed sodium carbonate, and from about 2 to 7 weight % of admixed citric acid.

13. A process for improving solubility or dispersibility of a granular laundry detergent composition according to claim 12, which composition further comprises from about 15% to about 30% by weight of an aluminosilicate ion exchange material of the formula $$Na_{12}[(AlO_2)_{12}(SiO_2)_{12}]\cdot xH_2O,$$

wherein x is from about 20 to about 30.

* * * * *

UNITED STATES PATENT AND TRADEMARK OFFICE

CERTIFICATE OF CORRECTION

PATENT NO. : 5,338,476

DATED : Aug. 16, 1994

INVENTOR(S) : Eugene J. Pancheri and Meleksima Koc

It is certified that error appears in the above-indentified patent and that said Letters Patent is hereby corrected as shown below:

On the title page, item [56], under References Cited, U.S. Patent Documents, change "11/1984" to --11/1989--.

In Column 4, line 17, change "moleties" to --moieties--.

In Column 11, line 47, change "7" to --2--.

In Column 11, line 54, change "mix said" to --mix, and admixing said detergent granules with a mixture consisting essentially of said--

In Column 12, line 53, change "mix;" to --mix and admixing a mixture consisting essentially of;--

In Column 12, line 54, change "b) sodium carbonate and admixing a mixture consist-" to --b) sodium carbonate; and--.

In Column 12, line 55 delete "ing essentially of: and".

In Column 12, line 67, delete "and admixing said detergent".

In Column 12, line 68 delete "granule with a mixture consisting essentially of".

Signed and Sealed this

Thirtieth Day of May, 1995

*Attest:*

*Attesting Officer*

Bruce Lehman

BRUCE LEHMAN

*Commissioner of Patents and Trademarks*